US007930968B2

(12) United States Patent
Giefing

(10) Patent No.: US 7,930,968 B2
(45) Date of Patent: Apr. 26, 2011

(54) CAM PIN WITH ROLLER FOR BOLT CARRIER

(76) Inventor: Peter C. Giefing, Phoenix, AZ (US)

( * ) Notice: Subject to any disclaimer, the term of this patent is extended or adjusted under 35 U.S.C. 154(b) by 93 days.

(21) Appl. No.: 12/489,592

(22) Filed: Jun. 23, 2009

(65) Prior Publication Data

US 2010/0319527 A1 Dec. 23, 2010

(51) Int. Cl.
*F41A 3/00* (2006.01)

(52) U.S. Cl. ..... 89/185; 42/16

(58) Field of Classification Search ..... 89/185, 89/191.01, 191.02, 192, 193, 194; 42/69.02, 42/16, 17, 19
See application file for complete search history.

(56) References Cited

U.S. PATENT DOCUMENTS

| | | | | |
|---|---|---|---|---|
| 1,912,757 | A * | 6/1933 | Brump | 74/10.9 |
| 2,570,292 | A * | 10/1951 | Umsted et al. | 74/89.14 |
| 3,071,225 | A * | 1/1963 | Blau et al. | 192/58.43 |
| 3,455,204 | A * | 7/1969 | Stoner | 89/33.2 |
| 3,724,325 | A * | 4/1973 | Silsby | 89/131 |
| 5,543,787 | A * | 8/1996 | Karidis et al. | 341/20 |
| 7,753,679 | B1 * | 7/2010 | Schuetz | 434/16 |
| 7,784,211 | B1 * | 8/2010 | Desomma | 42/16 |
| 7,827,722 | B1 * | 11/2010 | Davies | 42/75.02 |
| 2005/0223613 | A1 * | 10/2005 | Bender | 42/16 |

* cited by examiner

*Primary Examiner* — Troy Chambers
(74) *Attorney, Agent, or Firm* — Parsons & Goltry; Robert A. Parsons; Michael W. Goltry

(57) ABSTRACT

A bolt used in a self loading firearm employing a bolt carrier which in turn carries the bolt. The bolt includes a cam pin receptacle and a cam pin carried by the bolt. The cam pin includes a body having a received end and an exposed end. The received end is received in the cam pin receptacle with the exposed end extending outwardly from a surface of the bolt. A roller is rotatably coupled to the exposed end and rotatable around an axis of the body.

6 Claims, 6 Drawing Sheets

CAM PIN WITH ROLLER FOR BOLT CARRIER

FIELD OF THE INVENTION

This invention relates to auto-loading firearms.

More particularly, the present invention relates to improvements to firing mechanisms on auto-loading firearms.

BACKGROUND OF THE INVENTION

In the field of firearms, auto-loading firearms, which include semi-automatic and automatic rifles, often include a bolt carrier reciprocally moveable within an upper receiver, which moves a bolt of the firearm through a firing cycle. Many of these firearms employ a rotary bolt having lugs which is rotated to engage and disengage the lugs with a breech. During movement of the bolt carrier through the firing cycle, a cam pin, carried by the bolt, moves in a helical cam track formed in the bolt carrier. Movement of the cam pin in the cam track rotates the bolt to lock and unlock the lugs to the breech. The bolt carrier is moved within the upper receiver by various mechanisms such as gas or mechanical operating systems. The operating system moves a bolt carrier rearwardly from a forward firing position in which the bolt is in a locked position, to a rearward position. During the rearward movement, the bolt is unlocked from the breech and any casing is removed during the rearward movement. A buffer/action spring, typically a compression spring, moves the bolt carrier forwardly. During the forward movement, the bolt strips a cartridge from a magazine and pushes the cartridge into the firing chamber located at the breech end of the barrel. The lugs of the rotary bolt are moved to the locked position ready to fire. Apart from the rotary motion, the cam pin also moves along tracks formed in the upper receiver during forward and rearward movement of the bolt carrier. While the cam pin works effectively, the edges of the cam pin riding against portions of the upper receiver can cause scoring, and may inhibit the movement of the bolt carrier during the firing cycle.

It would be highly advantageous, therefore, to remedy the foregoing and other deficiencies inherent in the prior art.

SUMMARY OF THE INVENTION

Briefly, to achieve the desired objects and advantages of the instant invention provided is a firearm including a bolt having a cam pin receptacle and a cam pin carried by the bolt. The cam pin includes a body having a received end and an exposed end. The received end is received in the cam pin receptacle with the exposed end extending outwardly from a surface of the bolt. A roller is rotatably coupled to the exposed end and rotatable around an axis of the body.

In a specific aspect, the exposed end of the body includes a pintle, with the roller rotatably coupled to the pintle.

In another aspect, a firearm is provided which includes an upper receiver having a cam pin receiving slot terminating in a notch. A bolt carrier, including a forward end, a rearward end, and a camming aperture formed through a top surface thereof proximate the forward end, is carried by the upper receiver and reciprocally moveable between a forward position and a rearward position. A bolt is carried by the bolt carrier. The bolt includes a cam pin extending radially therefrom, the cam pin having an exposed end extending outwardly from a surface of the bolt, through the camming aperture and terminating in a roller rotatably coupled to the exposed end and rotatable around an axis of the cam pin. The roller rotatably engages walls of the slot of the receiver when the bolt carrier is moved toward the rearward position.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
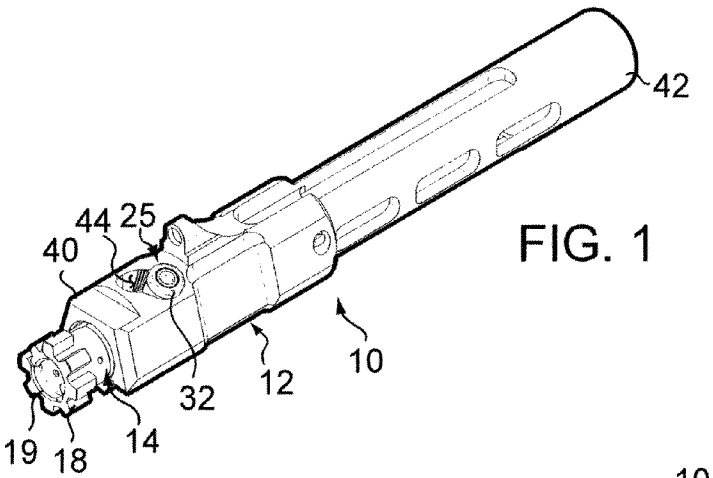
FIG. 1 is a perspective view of a bolt carrier and bolt with a cam pin according to the present invention.
Figure 2:
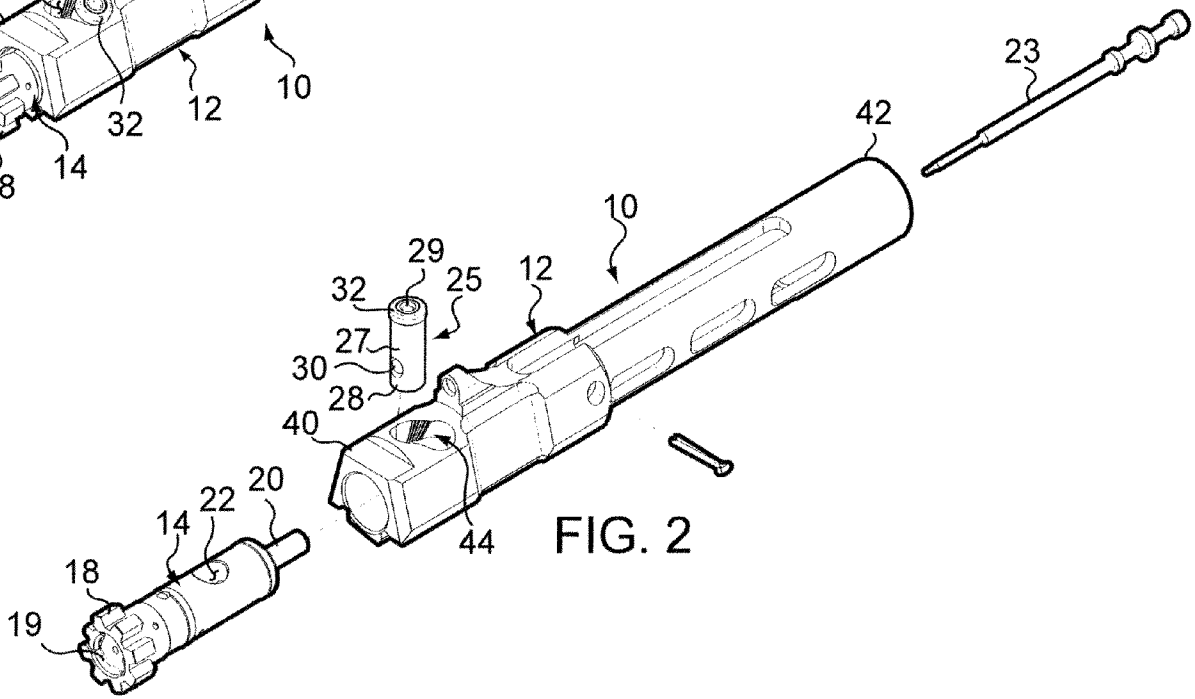
FIG. 2 is an exploded perspective view of the bolt carrier and bolt of FIG. 1.
Figure 3:
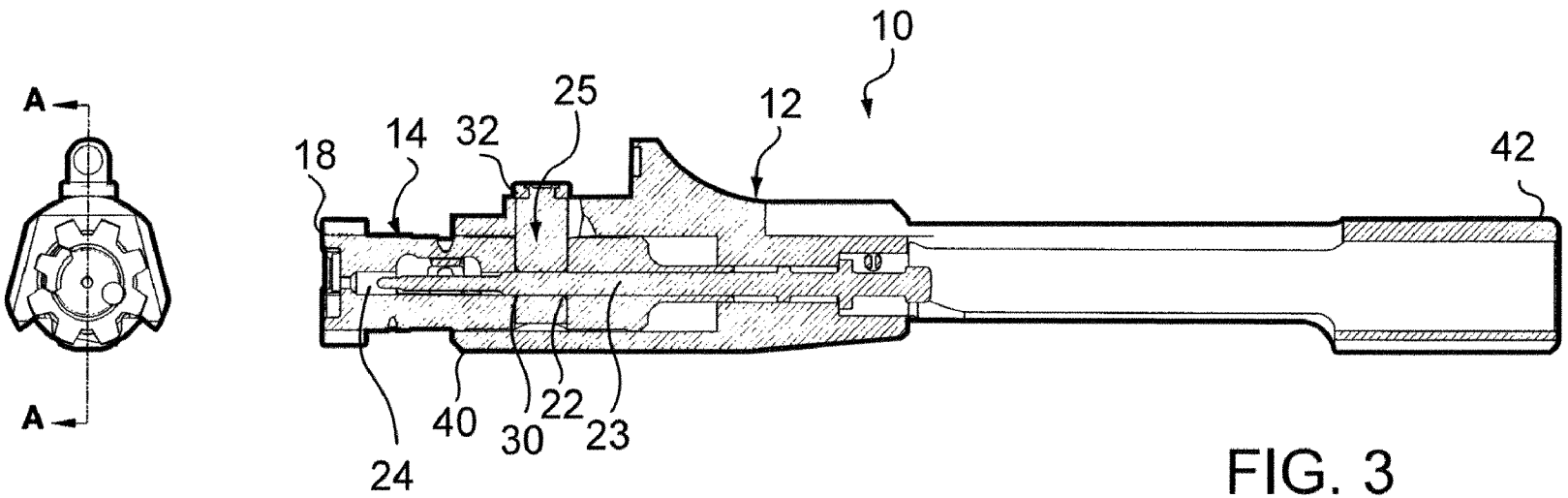
FIG. 3 is a sectional side view of the bolt carrier and bolt of FIG. 1.

Turning now to the drawings in which like reference characters indicate corresponding elements throughout the several views, attention is first directed to FIGS. 1, 2 and 3 which illustrate a bolt carrier assembly generally designated 10. Bolt carrier assembly 10 includes a bolt carrier 12 and a rotary bolt 14 carried thereby. Rotary bolt 14 includes lugs 18 at a forward end 19, a rearward end 20 and a cam pin receptacle 22. A firing pin 23 is carried by bolt 14, extending through a central, longitudinal bore 24 formed in bolt 14, and passes transversely through cam pin receptacle 22.

Figure 5:
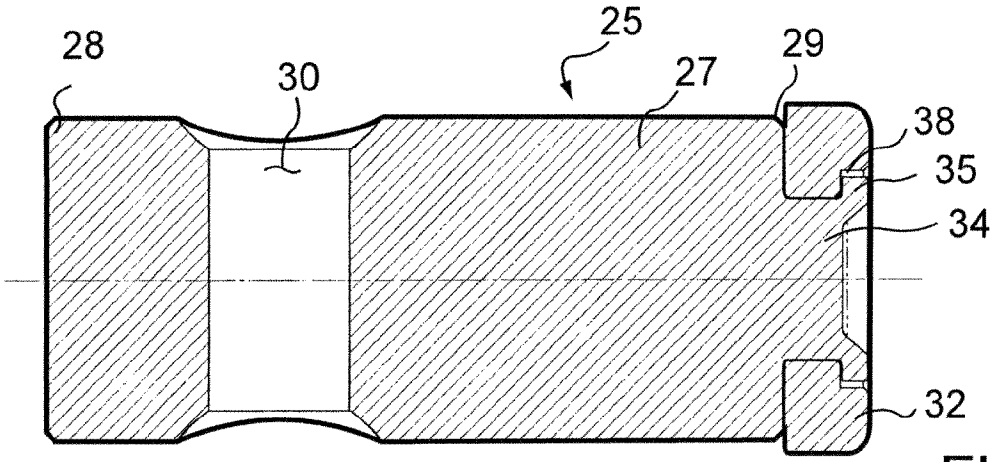
FIG. 5 is a sectional side view of the cam pin of FIG. 4.
Figure 4:
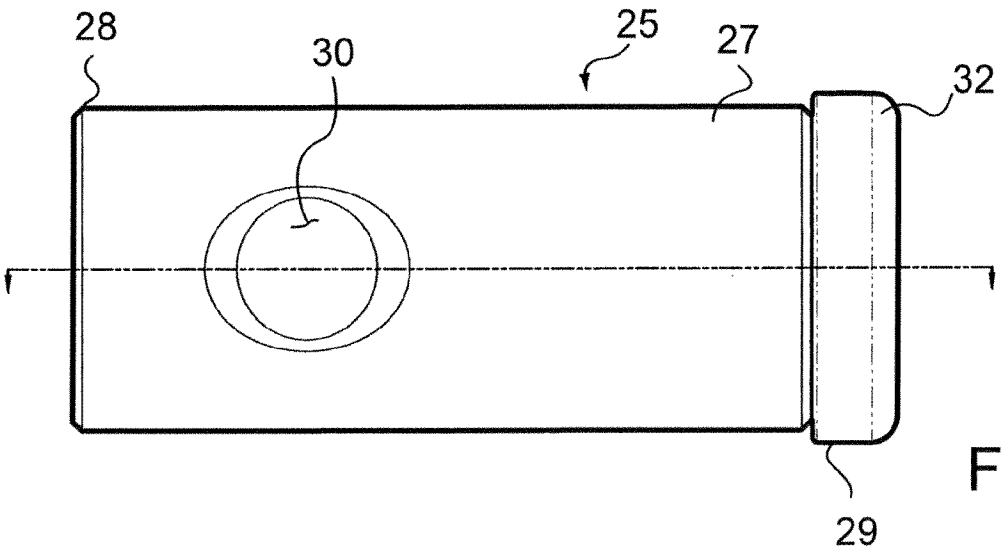
FIG. 4 is a side elevation of the cam pin of FIG. 1, according to the present invention.

With additional reference to FIGS. 4 and 5, a cam pin, generally designated 25, includes a generally cylindrical body 27 having a received end 28 and an exposed end 29. Received end 28 is carried within cam pin receptacle 22 with exposed end 29 extending radially outwardly therefrom. An aperture 30 extends through body 27 proximate received end 28 and is aligned with bore 24. Firing pin 23 extends along bore 24, and through aperture 30, registering cam pin 25 to bolt 14 and preventing rotation of cam pin 25. A roller 32 is rotatably coupled to exposed end 29 and is rotatable around a longitudinal axis of body 27. In this embodiment, roller 32 is an annular member received over a pintle 34 formed at exposed end 29. The end of pintle 34 is bent over (swaged, peened, etc) to form a flange 35 overlying a shoulder 38 formed in an inner wall of roller 32. Thus, roller 32 is coupled to body 27, while remaining free to rotate. Other methods of attachment of roller 32 can be employed, such as a central screw replacing flange 35, roller bearing, press fit pin with a head to hold a roller, and the like.

Still referring to FIGS. 1, 2 and 3, bolt carrier 12 is of substantially conventional construction. Bolt carrier 12 includes a forward end 40, a rearward end 42, and a camming surface in the form of an aperture 44 formed through the top surface thereof proximate forward end 40. Cam pin 25 extends from bolt 14 carried by bolt carrier 12 through aperture 44 with exposed end 29 carrying roller 32 extending past the outer surface of bolt carrier 12. The diameter of roller 32 is greater than the diameter of aperture 44, such that roller 32 prevents withdrawal of cam pin 25 inwardly through aperture 44. Thus, roller 32 resides outside the outer surface of bolt carrier 12.

Figure 6:
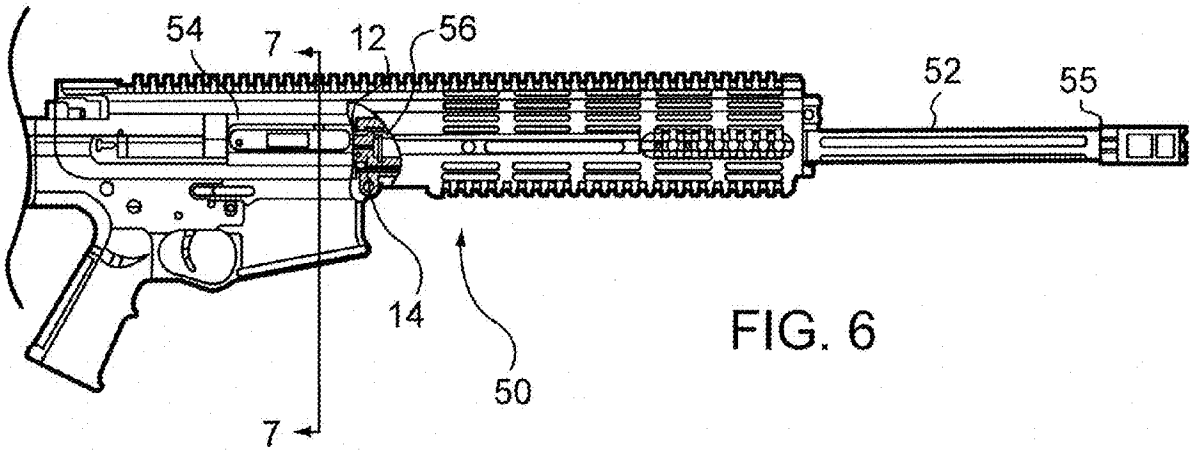
FIG. 6 is a side elevation of a rifle with the bolt carrier in a forward position and the bolt in the locked position.
Figure 7:
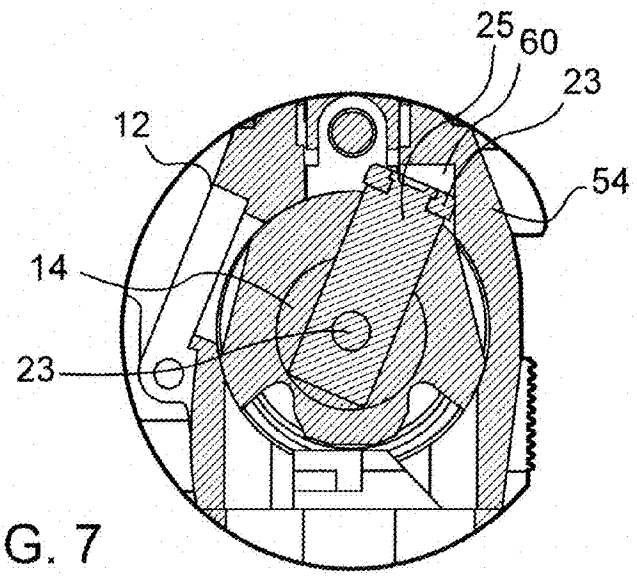
FIG. 7 is a sectional view taken along lines 7-7 of FIG. 6.

Referring now to FIGS. 6 and 7, illustrated is a firearm, generally designated 50, with a portion thereof removed to show bolt carrier 12 in the forward position with bolt 14 in a locked position, as will be described presently. Firearm 50 may be substantially any firearm utilizing a rotary bolt carried by a bolt carrier, typically an auto-loading rifle using a gas or pushrod operating system to move the bolt carrier through a firing cycle. In the embodiment illustrated, an AR15 or M16 type firearm is shown. Firearm 50 includes a barrel 52 coupled to an upper receiver 54. Barrel 52 includes a muzzle end 55 and a breech end 56. Upper receiver 54 is of conventional manufacture, and carries reciprocating bolt carrier 12 reciprocally movable between a forward position (firing position) and a rearward position. Bolt carrier 12 supports and positions rotary bolt 14. FIGS. 6 and 7 specifically illustrate the firing position wherein bolt carrier 12 is in the forward position with bolt 14 in a locked position, ready for firing. In the locked position, lugs 18 are engaged with breech end 56.

Figure 8:
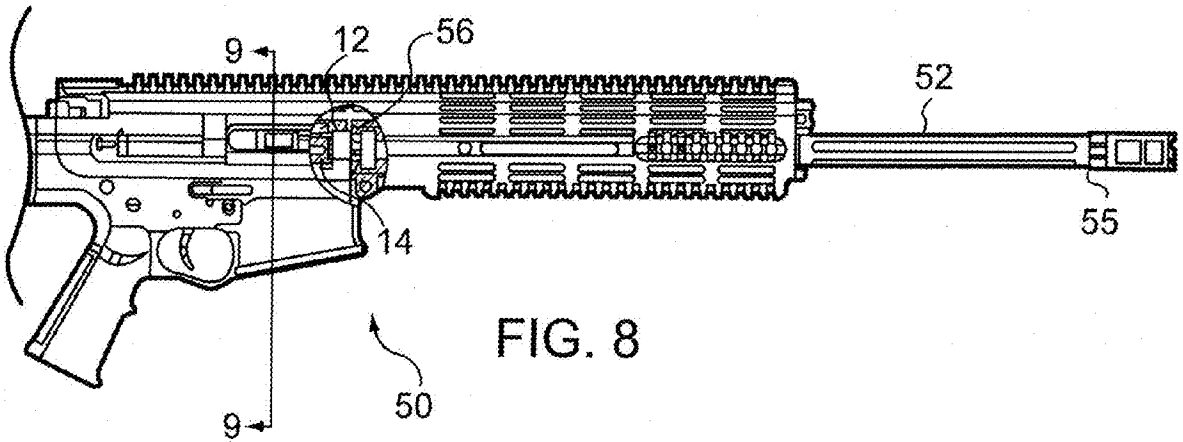
FIG. 8 is a side elevation of the rifle of FIG. 6, with the bolt carrier in a rearward position and the bolt in the unlocked position.
Figure 9:
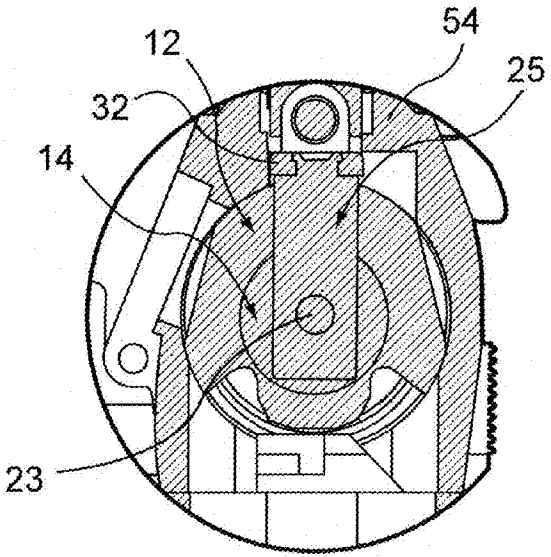
FIG. 9 is a sectional view taken along lines 9-9 of FIG. 8.

Referring to FIGS. 8 and 9, an unlocked positioned is illustrated. The unlocked position is any position other than the locked position but includes the position in which the bolt carrier moves rearwardly, rotating bolt 14 and disengaging lugs from breech. Rotation of bolt 14 is due to the interaction of cam pin 25 with cam aperture 44 as bolt carrier 12 moves rearwardly relative bolt 14. As bolt carrier 12 continues to moves rearwardly after bolt 14 is rotated unlocking it from the breech, movement of bolt 14 relative bolt carrier 12 ends, and bolt 14 is carried rearwardly with bolt carrier 12, permitting ejection of a casing and insertion of a cartridge. With specific reference to FIGS. 7 and 9, it can be seen that cam pin 25 is angled with respect to bolt carrier 12 with the bolt in the locked position (FIG. 7) and generally upright with respect to bolt carrier 12 with the bolt rotated to the unlocked position by cam pin 25 (FIG. 9). It is in the transition between the forward position and the rearward position of bolt carrier 12 that roller cam pin 25 becomes effective.

Figure 12:
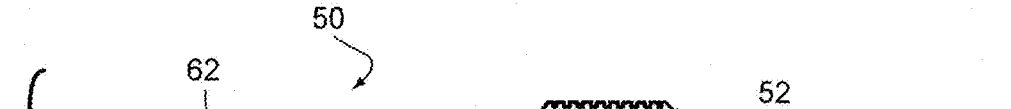
FIG. 12 is a top plan of the rifle of FIG. 10 with portions thereof cut away.
Figure 10:
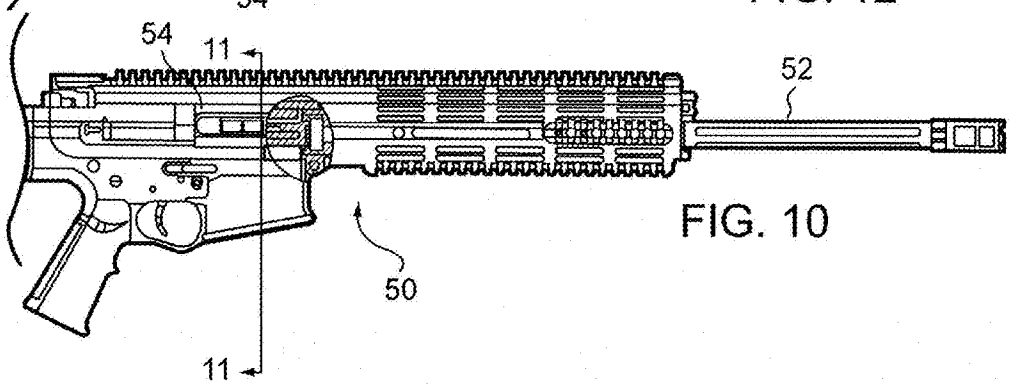
FIG. 10 is a side elevation of a rifle with the bolt intermediate the locked position and the unlocked position.
Figure 13:
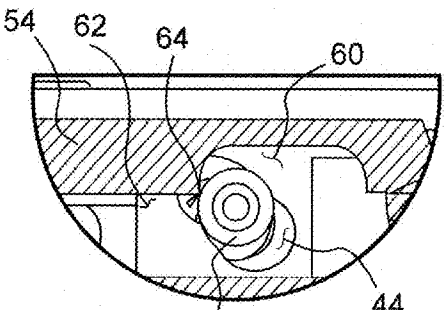
FIG. 13 is an enlarged view of the portion of the rifle of FIG. 12 having portions cut away therefrom.
Figure 11:
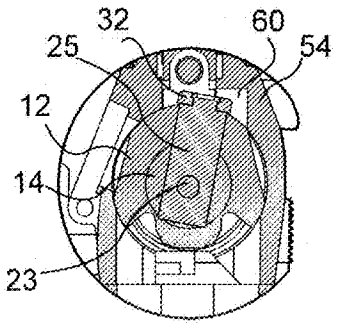
FIG. 11 is a sectional view taken along lines 11-11 of FIG. 10.

Turning now to FIGS. 10 and 11, firearm 50 is illustrated with bolt carrier 12 in a position intermediate the forward position and the rearward position, and bolt 14 intermediate the locked position and the unlocked position. With additional reference to FIGS. 12 and 13, it can be seen that a notch 60 in upper receiver 54 receives cam pin 25 in the locked position, allowing for the angle as seen in FIG. 7. When bolt 14 is rotated to the unlocked position, it moves rearwardly slightly as it is moved to the upright position illustrated in FIG. 9. As cam pin 25 moves to the upright position, it moves out of notch 60 and into a slot 62. Cam pin 25 acts to stabilize bolt 14 and bolt carrier 12 during the continued movement of bolt carrier 12 and bolt 14 rearwardly to the rearward position of bolt carrier 12. Cam pin 25 can stabilize bolt carrier assembly 10 by riding along the walls of slot 62 in upper receiver 54. To facilitate this function, roller 32 rotates when contacting the walls of slot 62 or notch 60, preventing undue wear and reducing drag and frictional forces on bolt carrier 12. In particular, an edge 64 formed between the walls of notch 60 and slot 62 is particularly susceptible to wear and damage. The transition of cam pin 25 from notch 60 to slot 62 is facilitated by roller 32 rolling over edge 64.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A firearm comprising:

a bolt having a cam pin receptacle; and a cam pin carried by the bolt, the cam pin comprising:

a body having a received end and an exposed end, the received end received in the cam pin receptacle with the exposed end extending outwardly from a surface of the bolt; and a roller rotatably coupled to the exposed end and rotatable around an axis of the body.

2. A firearm as claimed in claim 1 wherein the exposed end of the body includes a pintle, the roller rotatably coupled to the pintle.

3. A firearm comprising:

a bolt carrier including a forward end, a rearward end, and a camming aperture formed through a top surface thereof proximate the forward end, the bolt carrier reciprocally moveable between a forward position and a rearward position; and a bolt carried by the bolt carrier, the bolt having a cam pin extending radially therefrom, the cam pin having an exposed end extending outwardly from a surface of the bolt, through the camming aperture and terminating in a roller rotatably coupled to the exposed end and rotatable around an axis of the cam pin.

4. A firearm as claimed in claim 3 wherein the exposed end of the cam pin includes a pintle, the roller rotatably coupled to the pintle.

5. A firearm comprising:

an upper receiver including a cam pin receiving slot terminating in a notch;

a bolt carrier including a forward end, a rearward end, and a camming aperture formed through a top surface thereof proximate the forward end, the bolt carrier carried by the upper receiver and reciprocally moveable between a forward position and a rearward position; and a bolt carried by the bolt carrier, the bolt having a cam pin extending radially therefrom, the cam pin having an exposed end extending outwardly from a surface of the bolt, through the camming aperture and terminating in a roller rotatably coupled to the exposed end and rotatable around an axis of the cam pin, the roller rotatably engaging walls of the slot of the receiver when the bolt carrier is moved toward the rearward position.

6. A firearm as claimed in claim 5 wherein the exposed end of the cam pin includes a pintle, the roller rotatably coupled to the pintle.

* * * * *